US005088524A

United States Patent [19]

Omer et al.

[11] Patent Number: 5,088,524

[45] Date of Patent: Feb. 18, 1992

[54] DOUBLE LEFT DOBBY

[75] Inventors: Abdul W. Omer, Lahorn, Pakistan; Khalid Omer, 2212 Nathan Lowe Rd., Arlington, Tex. 76017

[73] Assignee: Khalid Omer, Pakistan

[21] Appl. No.: 425,685

[22] Filed: Oct. 23, 1989

[51] Int. Cl.[5] ..... D03C 1/06

[52] U.S. Cl. ..... 139/71

[58] Field of Search ..... 139/71, 72, 73, 74, 139/68, 330

[56] References Cited

U.S. PATENT DOCUMENTS 3,500,873 3/1970 Kleiner ..... 139/71
4,465,107 8/1984 Epis ..... 139/71 X

FOREIGN PATENT DOCUMENTS 3837631 6/1989 Fed. Rep. of Germany ..... 139/71
411732 11/1966 Switzerland ..... 139/71

*Primary Examiner*—Andrew M. Falik

[57] ABSTRACT

A double lift openshed dobby has a central shaft (1) on which are mounted a plurality of swing levers (2), each carrying a pair of articulated hooks (3), (4) kept inoperative by a spring (5), and two drive knives (13), (14) which are reciprocated at half the loop frequency in opposite phases to shed said swing levers selectively between two rest positions of openshed. In use, each swing lever is connected to a loom harness and defines a first of said rest positions when rested on a cross bar (12) against a downward bias; the other rest position being defined when the elevator (10), located by a cross bar (11), engages the notch (2a) in the swing lever. If a swing lever has to stay in its current rest position its hook pair is left inoperative; but if it has to be shed a hook of its hook pair is made to link by the action of the selector (6) with whichever of the two drive knives approaches its rest position first and, simultaneously, the elevator (10) is made to release or engage the notch (2a) as necessary. The hook pair and the elevator are both selected in unison by the same selector (6), which is actuated afresh on each loom cycle by a given arrangement of blanks and studs on a pattern cylinder (9).

3 Claims, 3 Drawing Sheets

Fig. 1
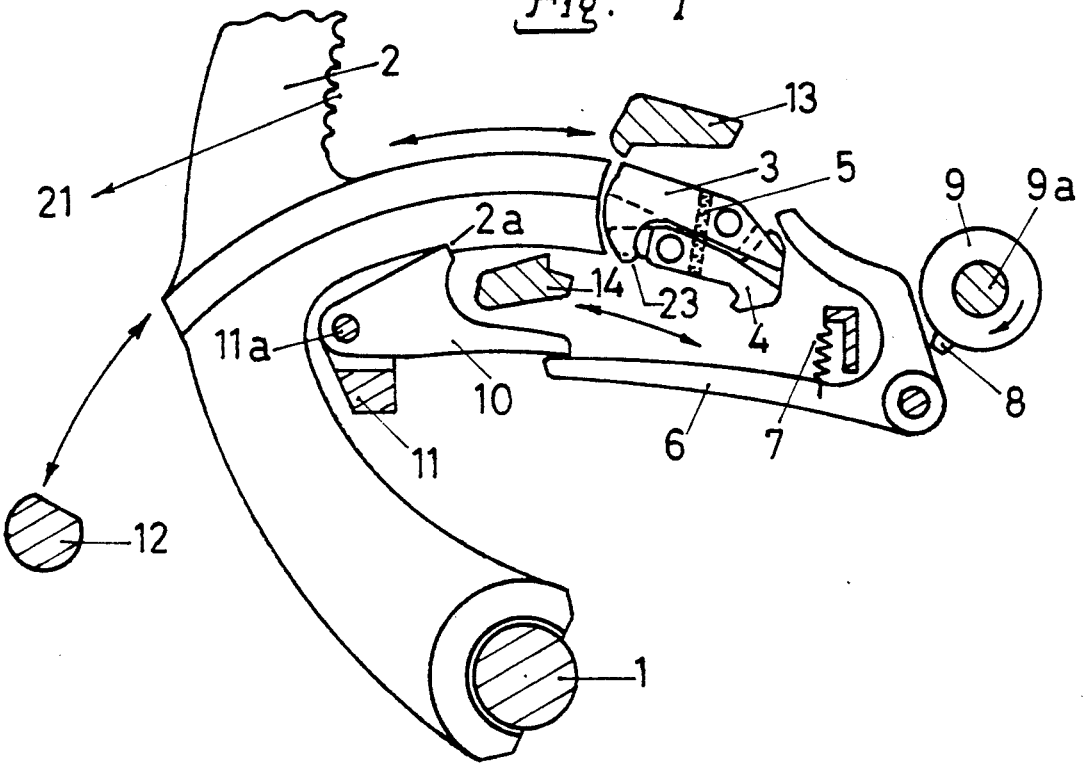
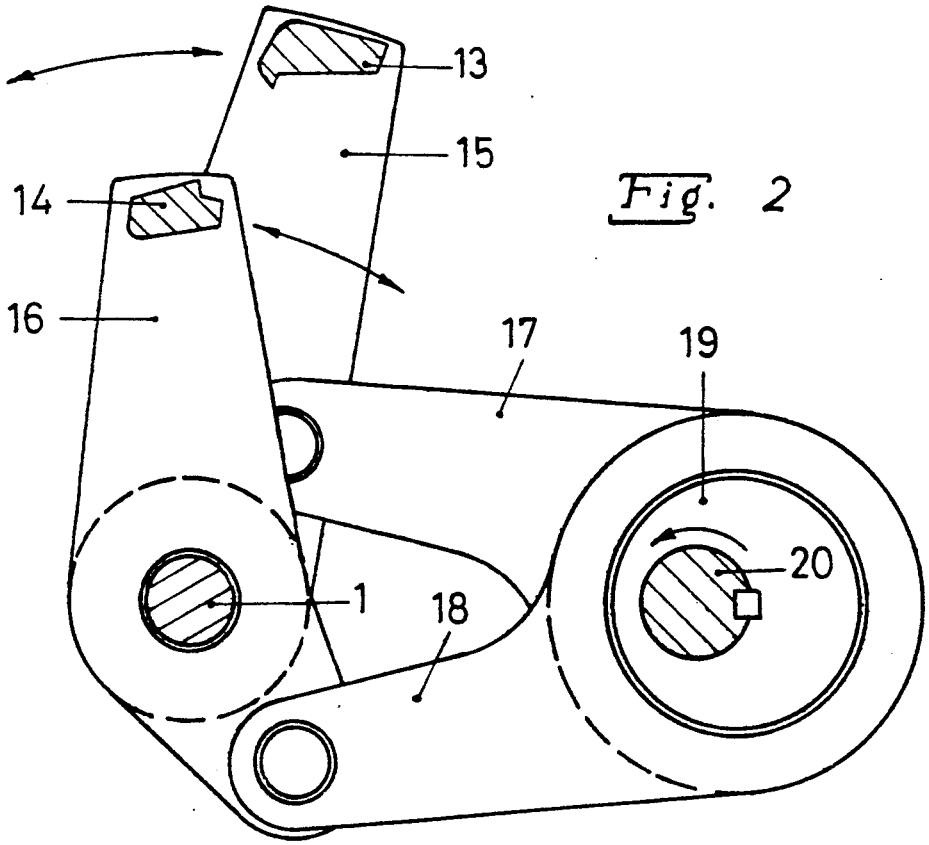
Fig. 2

Fig. 3
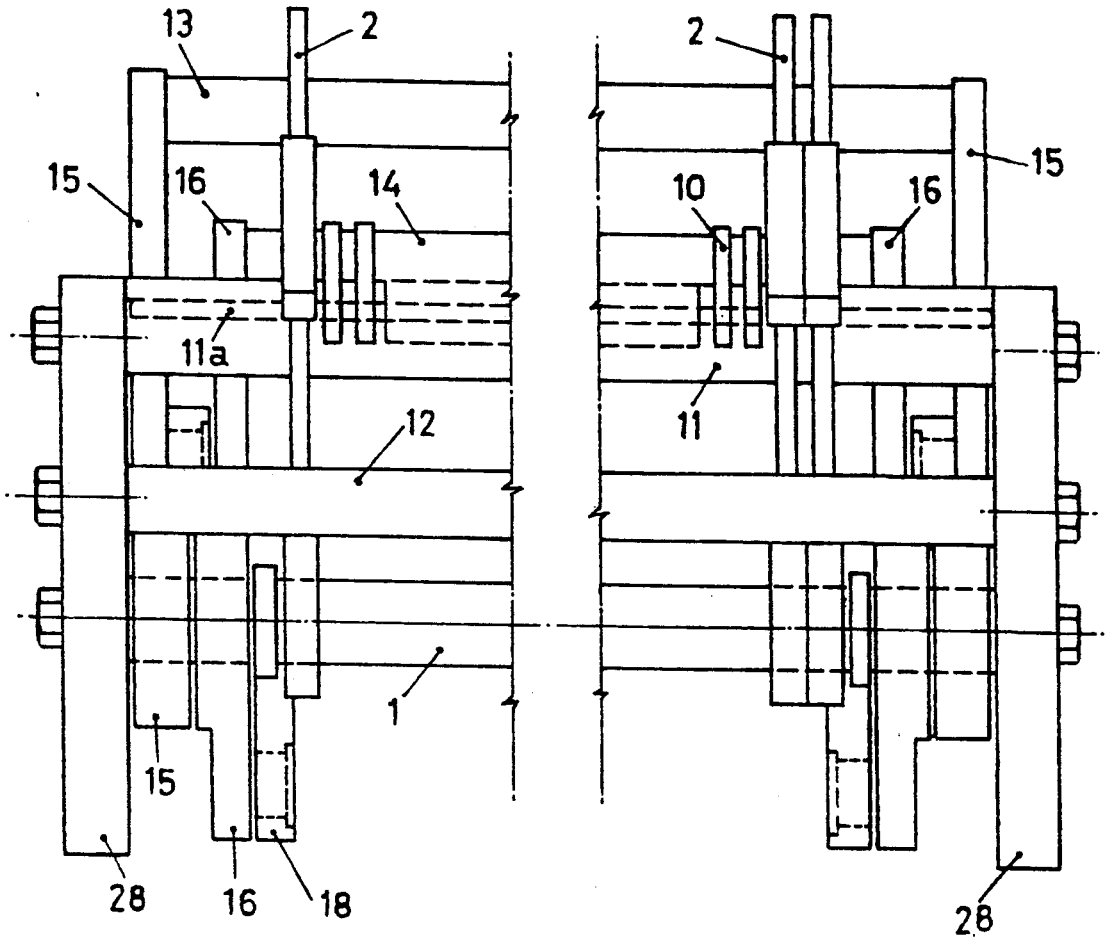
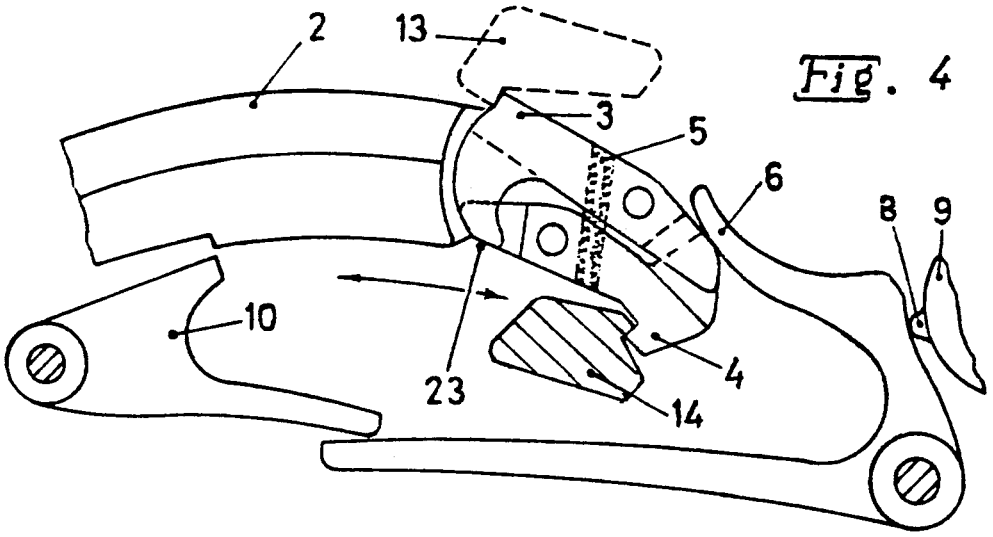
Fig. 4

DOUBLE LEFT DOBBY

This invention relates to double lift dobbies for shedding the warp harnesses of weaving looms. More particularly it relates to a reciprocating double lift openshed dobby having a pair of drive knives which are reciprocated at half the frequency of the related loom and are used to shed a series of swing levers or their connected warp harnesses selectively from two rest positions of openshed.

Dobbies of the above said class usually obtain one of their two rest positions of openshed by using the well known baulk system. It means, essentially, that each swing lever is operated from the center of a baulk lever, which center attains a rest position when the hooks attached to the baulk ends are driven simultaneously in opposite directions. Such dobbies can straightway transmit an inclined lift to the loom by allowing the effective lengths of their swing levers to be adjusted, but use up motion and energy for openshed action and cannot transfer more than a half motion of the drive through the center of the baulk lever. A static type of openshed action is, however, made available in dobbies derived from linear lift Jacquards. The advantages of this category of dobbies are that the knives and the hooks both move in straight line alignment, and no motion or energy is consumed for maintaining either of the two rest positions of openshed. Such dobbies usually transmit a fixed lift or motion through linear members, and hence are unable to directly transmit the adjustable lift needed for the formation of inclined shed. In general, the established advantage of the double lift system is that it allows most of the dobby components to operate at half the frequency of the related loom; and when combined with openshed action it ensures a minimum travel of warp threads during the shedding process. The phrase "loom frequency" used in this text has the same meaning as conveyed by picks per minute or r.p.m. of the crank shaft of the loom.

The object of the present invention is to utilize the best features of the above described two types of dobbies. Thus, according to the present invention, the drive mechanism is reciprocated at half the loom frequency; the loom harnesses are shed by swing levers which can transmit an inclined lift; the drive knives and the swing levers are both mounted and operated on one and the same central shaft in order to move in perfect alignment; and the baulk system is replaced by a hook pair and an elevator, which arrangement realises the openshed action without consuming motion or energy and allows the transmission of motion to the swing levers without intermediate loss.

In order to describe the invention in detail, reference is taken of the following drawings, in which:

FIG. 1 is an elevation in cross section showing a representative swing lever and its controls.

FIG. 2 is also an elevation in cross section showing an example of the drive mechanism.

FIG. 3 is an end view from the left side of FIGS. 1 and 2 showing the plurality of swing levers and the two drive knives mounted on one and the same central shaft.

FIG. 4 is an enlarged view of a part of FIG. 1, showing the hook pair in engagement with the drive knives.

Figure 6:
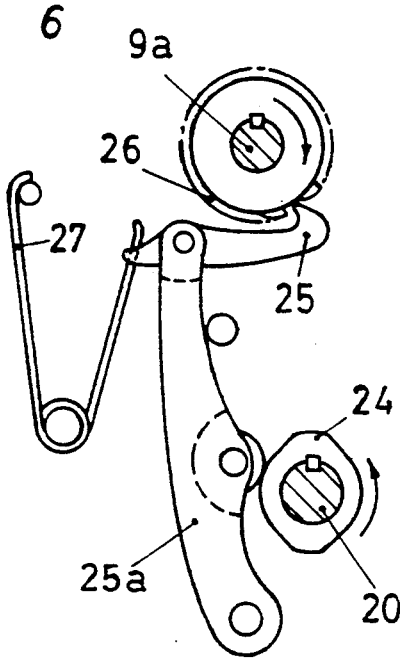
FIG. 6 shows a simple mechanism for transferring intermittent motion to the pattern cylinder.

Referring to FIG. 1 of the drawings, a fixed central shaft 1 carries on it a series of swing levers 2, of which only one representative member is shown. The right end of swing lever 2 is supplied with a slot in which two small articulated hooks 3 and 4 are hinged and kept in a neutral or closed position by the tension of spring 5. In FIG. 1, the front wall of the slot has been removed to give a clear view of the hooks. Both these hooks can be selected simultaneously from either end, and hence put in an open or active position by an L-shape selector 6, which is operated in turn by spring 7 and stud 8. Only one stud is shown, but actually a number of them are distributed, according to known weaving practice, on the steps of a pattern cylinder 9 rotated intermittently on shaft 9*a*, one movement or step on each loom cycle. FIG. 1 shows swing lever 2 resting in its upper rest position, which position is maintained as long as a blank is followed by a blank on the cylinder and selector 6, under tension of spring 7, keeps elevator 10 engaged with notch 2*a* of the swing lever. When selector 6 is selected with a stud, it presses down the right ends of hooks 3, 4 simultaneously and directly; the left ends of the hook pair are pressed at point 23 not directly by the selector but through elevator 10. A series of elevators 10, allocated one to each swing lever, are located by fixed bar 11 and pin 11*a*.

FIG. 2 shows an example of a simple drive mechanism. Two drive knives 13, 14 are carried on knife arms 15, 16 which are mounted to reciprocate in opposite directions about the central shaft 1. Cam followers 17, 18 connect arms 15, 16 to cam 19 in a manner shown in the figure. This cam is operated as an integral part of drive shaft 20, which rotates at half the loom frequency. The whole assembly is arranged as shown in FIG. 2. With this assembly each reciprocated knife will impart to the swing levers the same motion, substantially equal to the stroke length of its reciprocation, but this motion can be adjusted or modified by transmitting it to each different loom harness through a different effective lever length. In FIG. 1, the swing lever is shown carrying circular notches on its free upper length, representing the points of tapping the motion. Thus each successively higher notch will be delivering a gradually increasing lift. In this way an inclined lift to the loom harnesses is transmitted, which is indispensable in order that the warp threads may be divided into a smooth opening during the shedding process.

FIG. 3 is an end view taken from the left side of FIGS. 1 and 2. The main purpose of this figure is to show the manner in which the plurality of swing levers and the drive knives are mounted on one and same central shaft. The dobby side frames 28 are also shown in the figure, but the parts falling on the outer sides of the frames 28, i.e. the drive sprocket 31 (FIG. 7) on the left and the mechanism for intermittent motion (FIG. 6) on the right have not been included.

Figure 5:
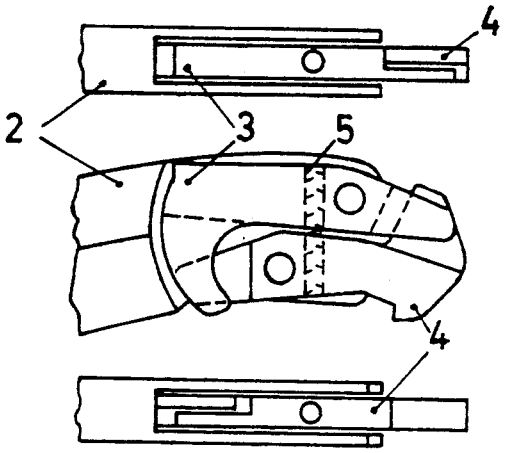
FIG. 5 is an enlarged diagram, not to scale, showing three views of the hook pair.

FIG. 4 and 5 show the functioning and construction of the linkage hook pair in detail. FIG. 4 elucidates the position which the hook pair will adopt when placed in an active state in the top rest position of the swing lever, say on the loom cycle next to the one shown in FIG. 1. It will be seen that when stud 8 pushes the selector 6 to forward position, the right leg of the selectors presses down the right ends of the hooks 3 and 4 simultaneously. Tracing the continuity of the motion from FIG. 1, the lower knife 14 will then approach the given rest position first and engage hook 4 as shown. However, on a subsequent pick, the upper knife 13 shown dotted may also reach the same position first and then would engage the hook 3 as shown. The two hooks will also assume a similar active position in the lower rest position of openshed when pushed from below at point 23. FIG. 5 provides details about the shape of the hooks pair 3, 4. The elevation, top and bottom views are supplied to convey clearly the shape of the hooks and their position in the swing lever slot, but for the sake of clarity the front wall of the slot in the elevation view has again been removed. The ends of hooks 3, 4 have been undercut from either side to reduce their thickness, as shown in the top and bottom views of FIG. 5, to allow them to overlap each other and be accommodated in the same width of the slot.

FIG. 6 shows a pawl and ratchet mechanism for imparting intermittent motion to pattern cylinder 9, one motion or step on each loom cycle. To one end of drive shaft 20 is fixed a double cam 24 which rotates with the shaft speed. The double cam operates pawl 25 through pawl lever 25*a* once in each half rotation of shaft 20, and hence the pawl moves ratchet 26 once in each loom cycle since the speed of shaft 20 is equal to half the loom speed. Ratchet 26 is fixed to pattern cylinder 9 and is rotated with the cylinder on shaft 9*a*. A spring 27 keeps the pawl and the pawl lever in proper orientation required for the functioning of the mechanism.

Figure 7:
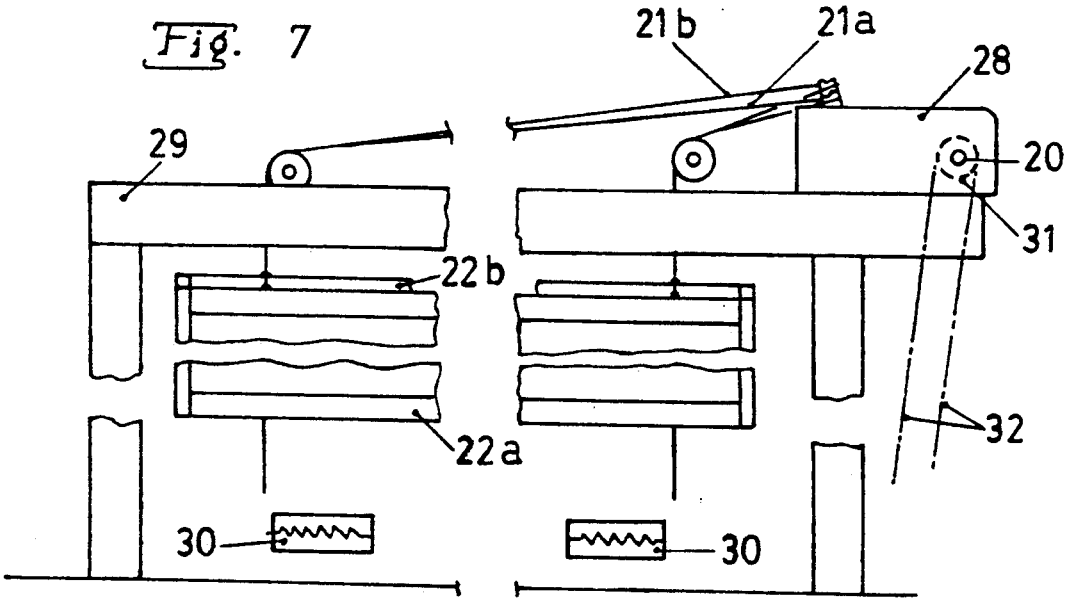
FIG. 7 is a diagramatic view of a weaving loom showing connection of the swing levers with loom harnesses.

FIG. 7 is a diagramatic view showing the dobby mounted on a loom 29 as looked from the front. Two of the dobby's swing levers, one behind the other, are connected with strings 21*a*, 21*b* to the loom harnesses 22*a*, 22*b* for transmitting an inclined lift. String 21*b* taps its motion from a slightly greater lever length, shown exeggarated, than that used for string 21*a*, and hence a slightly greater lift is transmitted to the harnesses 22*b* than that transmitted to harnesses 22*a*. Thus each successive loom harness can be imparted a gradually increasing lift, necessary for the formation of a smooth inclined shed. The loom harnesses are biased downwards by spring action, say by using a biasing mechanism 30.

The coupling arrangement of the dobby with the loom through sprocket 31 and chain 32 is also diagramatically shown in FIG. 7. Sprocket 31 forms an integral part of shaft 20 at the back end as shown in FIG. 7, and motion is transmitted to it by chain 32. The chain is geared with, say either the crank shaft or the bottom shaft of the loom, not shown, in such manners that shaft 20 is rotated at half the loom frequency. Thus, as made clear in FIG. 2, the knives 13, 14 are made to reciprocate also at the same half frequency, while the extreme positions of the reciprocated knives are designed to correspond with the two rest positions of openshed.

The positions of the swing levers given in FIGS. 1, 2 and 3 all correspond to the upper rest position of openshed, which is the case when the selection is made by a blank on the pattern cylinder. In operation, however, some of the swing levers will always rest in the lower rest position as well. The point to note is that the upper position of the swing levers is maintained without consuming motion or energy. If the swing lever is required in the lower rest position on a subsequent pick or cycle a stud 8 is made to replace the blank, which will happen on the next pick if the sequence of FIG. 1 is followed. This particular situation is shown in FIG. 4, in which reference it may further be noted that, after its engagement with a hook 3 or 4 a knife must push the swing lever slightly forward to allow the corresponding notch 2*a* release the elevator 10. The swing lever will then be brought down to the lower rest position by the related knife under spring bias 30. The final position is attained when the swing lever comes to rest against the cross bar 12. Obviously, this second rest position will also be maintained without consuming motion or energy as long as a stud will be followed by a stud on the pattern cylinder. But as soon as a blank replaces the stud, spring 7 pulls selector 6 upwards, and so its left leg presses the hooks 3, 4 at the point 23 through the elevator 10. As the hooks 3, 4 again become active, one of them is engaged with whichever of the two knives 13, 14 approaches the lower rest position first. The swing lever is then moved to the upper rest position and is retained there by elevator 10 as described before.

It may be appreciated that since the full motion of the knives is transmitted to the loom harnesses, with the adjustment needed for inclined lift, and since the knives and the swing levers can both be operated in perfect alignment in a wide angle of swing, no need will exist for using long swing levers or a second stage amplification. In the baulk system dobbies, on the other hand, complications occur since only a half motion of the knives can be transmitted to the swing levers and the drive and the driven members all move in misalignment after engagement. Thus two notable advantages of the present dobby, according to this invention, are the transmission of full and large enough motion of the drive to the swing levers and the provision of static openshed action which does not depend on the use of motion or energy.

We claim:

1. A double lift openshed dobby for selectively shedding the warp harnesses of a weaving loom comprising: a drive mechanism which includes two drive knives reciprocated in opposite phases at half the frequency of the related loom; a plurality of swing levers which are mounted and selectively operated on one and the same central shaft on which said drive knives are mounted and operated and, in use, transmit an inclined lift to the loom harnesses which they shed and to which they are individually connected; means for holding said swing levers in two static rest positions selectively to define a static openshed; linkage means carried directly in each swing lever for linking this lever selectively in either of said rest positions with either of said drive knives for movement therewith between said rest positions; and selection means which selects said swing levers to stay in their current static rest positions or move therefrom on each stroke of said drive knives according to a predetermined program of shedding.

2. A double lift openshed dobby according to claim 1, wherein said drive knives and said swing levers are both mounted and operated on one and the same central shaft to allow perfect alignment between the two during motion; that said static rest positions of the swing levers are maintained without consuming motion or energy; and that said linkage means links directly and without loss each motion of said drive knives with any of the selected swing levers from either of said rest positions.

3. A double lift openshed dobby according to claim 1, wherein said means for holding said swing levers in said two static rest positions selectively comprises a lower fixed bar and a plurality of selectively operated elevators located by an upper fixed bar, whereby one of the two rest positions is defined when the swing levers come to rest on the lower bar due to downwards spring bias allowed according to a negative shedding practice and a second of the two rest positions is defined as said elevators, allotted one to each swing lever, are selected by said selection means to engage matching notches in the corresponding swing levers when these levers are moved to reach the second rest position.

* * * * *